United States Patent [19]

de Groot

[11] 4,004,511

[45] Jan. 25, 1977

[54] PRINTING APPARATUS

[75] Inventor: Jacobus Henricus de Groot, Noordwijkerhout, Netherlands

[73] Assignee: B.V. Korthofah, Rijnsburg, Netherlands

[22] Filed: Nov. 18, 1975

[21] Appl. No.: 633,163

[30] Foreign Application Priority Data

Nov. 25, 1974 Netherlands ..... 7415324

[52] U.S. Cl. ..... 101/334; 101/301; 101/310; 101/41

[51] Int. Cl.[2] ..... B41K 1/42

[58] Field of Search ..... 101/41, 301, 310, 318, 101/333, 334, 335; 210/172

[56] References Cited

UNITED STATES PATENTS

| | | | |
|---|---|---|---|
| 1,677,501 | 7/1928 | Stone et al. | 210/172 X |
| 2,624,463 | 1/1953 | Freese | 210/172 X |
| 3,165,468 | 1/1965 | Strader | 210/172 |
| 3,216,352 | 11/1965 | Schnackel | 101/333 |
| 3,706,274 | 12/1972 | Coville | 101/333 |
| 3,779,164 | 12/1973 | Study | 101/333 |
| 3,804,016 | 4/1974 | Marozzi et al. | 101/333 |

FOREIGN PATENTS OR APPLICATIONS

| | | |
|---|---|---|
| 7,203,312 | 3/1972 | Netherlands |

*Primary Examiner*—Edward M. Coven

[57] ABSTRACT

An apparatus for applying markings to packed articles transported by a conveyor is provided with a stamp, which is laterally expulsed when an article passes by. The stamp comprises a holder and a printing head connected with the holder by at least one spring. The lateral movement of the holder is interrupted by an abutment in the driving mechanism before the printing head reaches the article, after which the printing head is shot out by the kinetic energy so as to hit the article. The printing head engages an ink pad in the intervals between successive printing operations. The ink pad is attached to the bottom of an ink container by means of a bearing ring and is made of a hard porous material. The printing head is provided with a resilient ring tightly engaging the edge of the bearing ring when the printing head lies against the ink pad. Thus, a suction occurs when the printing head leaves the ink pad, whereby the ink is drawn into the ink pad from the container.

7 Claims, 7 Drawing Figures

PRINTING APPARATUS

BACKGROUND OF THE INVENTION

Dutch patent application No. 72,03312, filed on Mar. 13, 1972 and published on Sept. 17, 1973, discloses a printing apparatus for applying markings to a plurality of packed articles, passing the apparatus on a conveyor, comprising a stamp, which is laterally expulsed from the apparatus upon the passing of an article by a vertical displacement of a driving rod connected with the stamp by means of an articulated rod system, so that the article is hit by the stamp, the said stamp consisting of a holder to which a printing head is attached by means of at least one spring and of which the lateral movement is interrupted by an abutment arranged in the path of the driving rod before the printing head has reached the article, after which the printing head is shot further outwardly by the kinetic energy, hits the article and is retracted by the spring, the stamp being displaced by the movement of the driving rod from a vertical rest position in which the printing head engages an ink pad to a horizontal operating position.

A printing apparatus of this kind may be used e.g. to apply a date or a price to a plurality of articles. The apparatus is actuated by the proximity of an article, which may be sensed in any desired manner e.g. by means of a mechanical sensor engaging the article, a photocell or a pneumatic sensor responsive to the interruption of an air current. After the sensor has signaled the presence of an article, the printing apparatus is actuated with a suitable delay, whereby the stamp shoots outwardly and applies the desired marking to the article. The printing head is inked each time when the stamp occupies the rest position. The known apparatus has the disadvantage that the ink does not always supply the same amount of ink to the printing head during the inking process, because it is not possible to control the ink supply to the ink pad with a sufficient accuracy. In the known apparatus the ink pad, to which the ink is directly supplied, is made of felt and the ink seeps through the ink pad from the top to the bottom. However, since the ink always contains small pigment particles, which are captured by the ink pad on their way down, the porosity of the ink pad decreases after some time, so that an insufficient amount of ink is supplied to the ink pad. A further disadvantage of the known apparatus is that the ink pad is subject to heavy wear due to the impact of the printing head, so that it has to be replaced at frequent intervals.

U.S. Pat. No. 3,797,390 (Marozzi et al.) discloses an ink cartridge for a film marking apparatus, comprising an ink container having a foam-like filler spaced from a closed end and exposed to a marking device at an open end through a porous ink pad, which is made of felt. The filler is compressed when the printing head engages the ink pad, and expands again when the printing head is removed, whereby a pumping action is obtained to cause a flow of ink through the filler to the ink pad. Both the ink pad and the filler are subject to heavy wear due to the impact of the printing head.

BRIEF SUMMARY OF THE INVENTION

It is the object of the invention to provide an improved printing apparatus of the kind disclosed in the above-mentioned Dutch patent application, whereby the disadvantages of the known apparatus are removed.

It is a further object of the invention to reduce the wear of the ink pad by making the same of a hard porous material.

It is a further object of the invention to provide a pumping action to cause a flow of ink to the ink pad without the use of any compressible materials subject to heavy wear.

It is a further object of the invention to prevent the ink pad from being clogged by pigment particles.

According to the invention, the ink pad is made of a hard porous synthetic material and mounted in a bearing ring attached to the bottom of an ink container, and a resilient ring arranged in the end face of the stamp tightly engages the edge of the bearing ring in the rest position of the stamp, so that a suction is obtained when the stamp is displaced to the operating position, whereby the ink is drawn into the ink pad from the container. In addition, the resilient ring engaging the edge of the bearing ring prevents the ink pad from drying up if the apparatus is out of use.

In a preferred embodiment of the invention the ink pad lies against the bottom of the ink container and an annular groove is provided in said bottom, whereby the ink from the container is equally distributed over the surface of the ink pad.

It is of advantage if an overflow tube secured in the bottom of the ink container communicates with said groove and if the top of said overflow tube is spaced at some distance from the bottom of the container. In this manner, the pigment particles are prevented from reaching the ink pad, since these particles are collected on the bottom of the ink container below the level of the top of the overflow tube.

In order to improve the separation of the pigment particles from the ink supplied to the ink pad, it is of advantage if the ink container comprises two superposed chambers, the overflow tube being arranged in the lower chamber, which is connected with the upper chamber by means of a channel of which the top is spaced at some distance from the bottom of the upper chamber.

Furthermore, it is of advantage if the maximum suction exerted by the resilient ring is limited by one or more reducing openings provided in the printing head and if the suction exerted by the resilient ring may be adjusted together with the ink supply by means of an adjusting screw modifying the height of the ink container with respect to the stamp.

DETAILED DESCRIPTION

Figure 1:
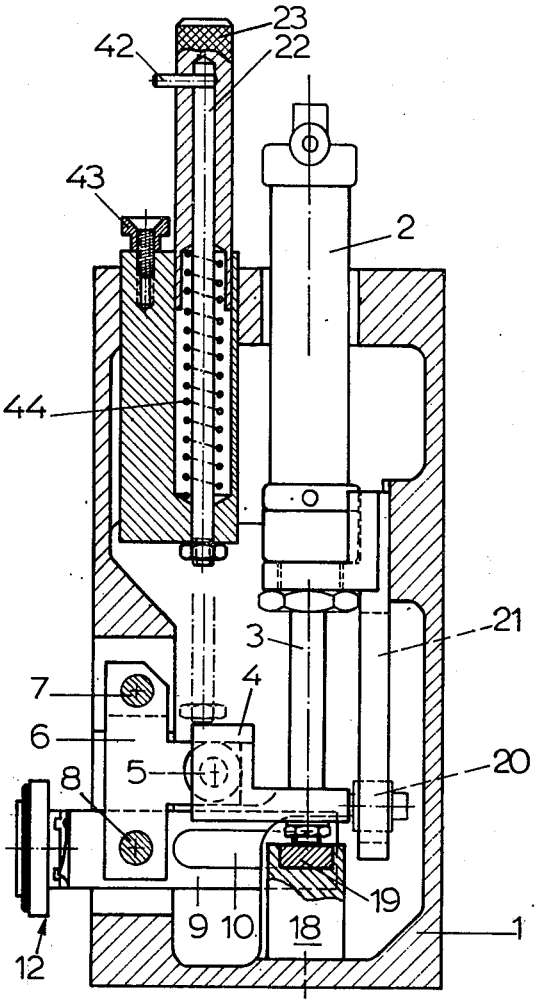
FIG. 1 shows the section of a printing apparatus according to the invention along a vertical plane, wherein the stamp is in its operative position.

The printing apparatus shown in the drawing comprises a housing 1, in which a pneumatic driving cylinder 2 is arranged; the piston, displaceable in the cylinder 2 is connected with a driving rod 3 movable in a vertical direction. An L-shaped member 4 rigidly attached to the driving rod 3 is hingedly and slidably connected at a point 5 with the leg of a T-shaped link 6; the top end of the cross beam of the link is rotatable about a point 7 fixedly arranged in the housing and the lower end of the cross beam is hingedly connected at a point 8 with the holder 9 of the stamp. The holder 9 is provided with a slot 10 engaging a roller 11, which is fixedly arranged in the housing. A printing head 12 connected with the holder 9 by means of one or more springs comprises a carrier 13 for the printing types 14.

In FIG. 1, the printing apparatus is shown in the operative position, which is occupied immediately before and after the printing operation. In this position, the holder 9 is horizontal and the driving rod 3 is in its lowermost position. The apparatus is returned to the rest position by an upward movement of the driving rod 3 together with the L-shaped member 4. During this movement, the point 5 is also upwardly displaced so that the link 6 is forced to turn around the point 7; as a consequence, the point 8 describes an upwardly directed circle around the point 7, whereby the holder 9 is upwardly displaced. Since the right hand end of the holder is kept at a fixed level by the roller 11, the holder 9 turns about the roller 11; if necessary the slot 10 is displaced with respect to the roller 11. The various coupling elements have such dimensions that the holder 9 is in a vertical position when the driving rod 3 has obtained its uppermost position.

Figure 2:
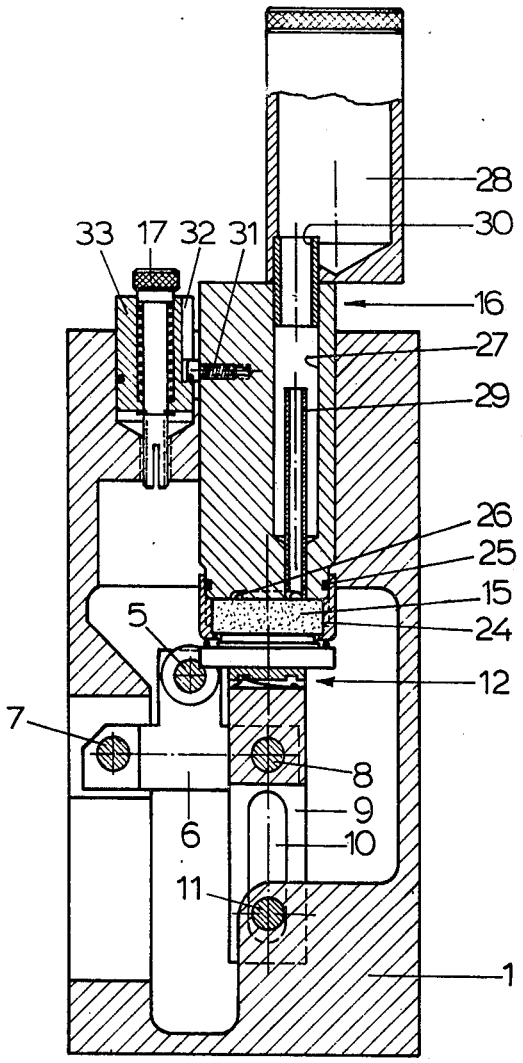
FIG. 2 shows a section of the same printing apparatus along a vertical plane behind the plane of the section in FIG. 1.

This vertical rest position is shown in FIG. 2. The cross beam of the link 6 is in a horizontal position and the printing types 14 are pressed against an ink pad 15 provided at the lower end of an ink container 16; if necessary, the level of the ink container may be adjusted by means of a screw 17. Thus, the printing types are always inked after each printing operation.

The downward displacement of the driving rod 3 is limited by an abutment 18 screwed to the bottom of the housing and provided with a wear resistant insert 19. At the moment, at which the driving rod reaches the abutment 18, the holder 9 has a relatively large horizontal speed component. When the driving rod hits the abutment 18, whereby the mechanism is stopped, the printing head 12 shoots outwardly due to the kinetic energy, whereby the printing head is removed from the holder 9. During this outward movement of the printing head 12, the printing types 14 are pressed against the article, whereby the required marking is obtained. However, as the printing head 12 is connected with the holder 9 by one or more springs, it is immediately retracted after its engagement with the article, so that the printing types only engage the article for a very short time. The formation of a blurred marking is effectively prevented in this manner.

The driving rod 3 is prevented from rotation by means of a roller 20 mounted on a shaft attached to the L-shaped member 4 and running in a slot 21 of the housing.

When the printing types 14 must be exchanged, the stamp must be expulsed for this purpose. However, it is unsuitable to use the pneumatic cylinder 2 to this end. Hence the apparatus is provided with a pressure rod 22 by means of which the L-shaped member 4 may be downwardly displaced together with the driving rod 3 and which may be actuated by means of a knob 23.

As appears most clearly from FIG. 2, the ink pad 15 is held on the lower end of the container 16 by means of a bearing ring 24 screwed on said lower end and having an inwardly directed flange retaining the ink pad 15; a sealing member 24 in the shape of an O-ring is provided between the container and the bearing ring. The underside of the bottom of the ink container 16, which lies against the ink pad 15 is provided with an annular groove 26, in order to distribute the ink from the container over the surface of the ink pad. The container 16 comprises two chambers 27 and 28, eccentrically arranged one above the other. The lower chamber 27 comprises an overflow tube 29 extending through the bottom of the container and communicating with the annular groove 26. The top of the overflow tube 29 is spaced from the bottom of the chamber 27, so that the pigment particles of the ink in the lower chamber 27 are collected on the bottom of this chamber and are not passed through the overflow tube 29 and the groove 26 to the ink pad. In this manner, the ink pad, which is made of a hard porous synthetic material is prevented from being clogged by the pigment particles. The chambers 27 and 28 of the ink container 16 are interconnected by a channel 30 the top of which is spaced from the bottom of the upper chamber, whereby the majority of the pigment particles of the ink in the upper chamber settle on the bottom of said chamber and are not carried along through the channel 30 to the lower chamber 27. The remaining pigment particles, which still reach the lower chamber 27, settle on the bottom of the lower chamber as described above.

The container 16 is detachable and is held in the housing 1 by a catch 31 screwed into the wall of the lower chamber 27 of the container and engaging an L-shaped slot 32 of a sleeve 33, which is vertically displaceable with respect to the housing by means of an adjusting screw 17 in such manner that the level of the container 16 in the housing may be accurately adjusted.

Figure 6:
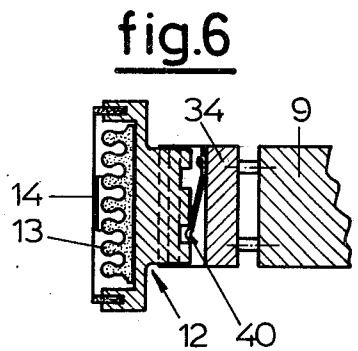
FIG. 6 shows a section of the stamp along the line VI—VI in FIG. 7, wherein the stamp is removed from the holder.
Figure 7:
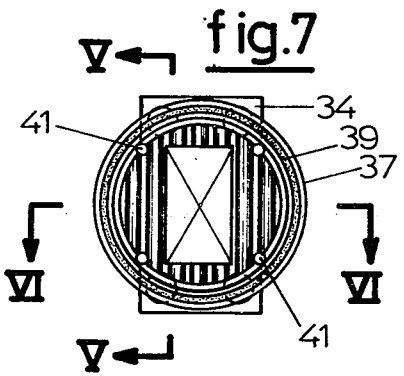
FIG. 7 shows a front view of the stamp.
Figure 5:
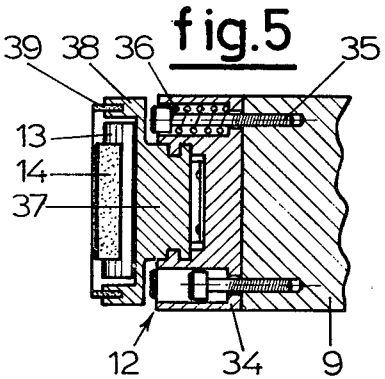
FIG. 5 shows a section of the stamp along the line V—V in FIG. 7, wherein the printing head lies against the holder.

As appears most clearly from FIGS. 5, 6, and 7, the printing head 12 comprises a sliding block 34, which is resiliently connected with the end of the holder 9. For this purpose, the holder contains a plurality of bolts 35, each screwed into a bore of the sliding block 34. Preferably there are four of the bolts 35. The diameter of the bore, in which each bolt is inserted, is larger than the diameter of the head of the bolt, so that the sliding block is free to remove itself from the holder 9. For at least two of the bolts, which are diametrically opposed to each other, a compression spring 36 is arranged between the head and a shoulder at the inner end of the bore. When the printing head 12 is displaced from the holder 9 as shown in FIG. 6, the springs 36 are compressed and they expand again after the printing head has come to a standstill, whereby the printing head is retracted to the holder.

The printing head 12 is further provided with an end piece 37 including the above mentioned carrier 13 for the types 14. The end piece 37 has an upstanding edge 38 arranged slightly below the level of the types 14 arranged in the carrier 13. A resilient ring 39 is attached in the end face of the upstanding edge 38; the purpose of said resilient ring will be described later on. The end piece 37 is detachably connected with the sliding block 34 by means of slots and ribs, so that the end piece 37 may be easily removed by sliding it laterally out of the sliding block 34. The end piece 37 is held in the sliding block by means of a spring 40 engaging a corresponding recess of the end piece.

Figure 4:
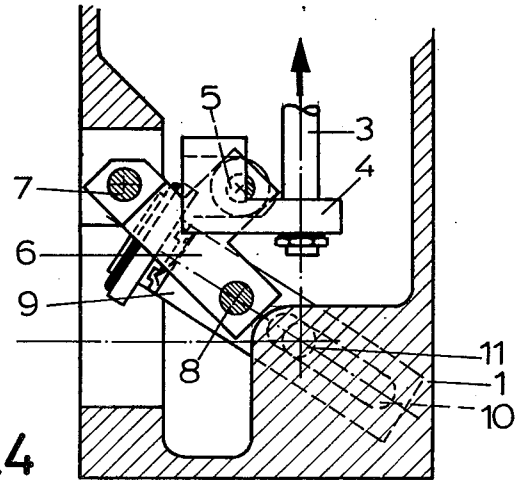
FIGS. 3 and 4 show schematically the lower portion of the printing apparatus according to the FIGS. 1 and 2 in the operating position and during the displacement to the rest position, respectively.
Figure 3:
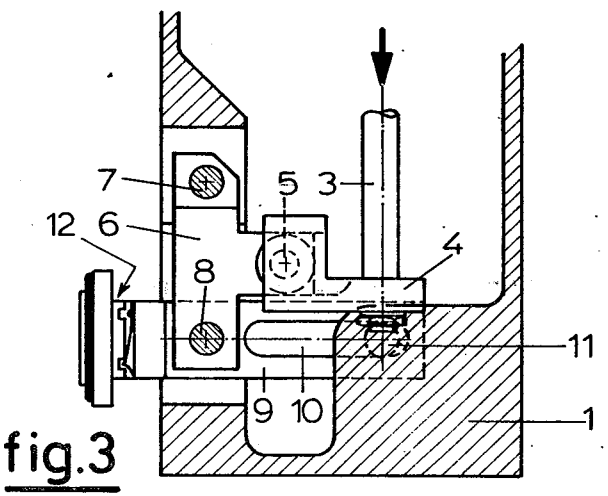

When the printing head 12 occupies the rest position shown in FIG. 2, the types 14 arranged in the carrier 13 of the printing head engage the ink pad 15, and the resilient ring 39 is in tight engagement with the edge of the bearing ring 24, which holds the ink pad 15 against the bottom of the container 16. In this manner, a suction is produced when the printing head is displaced to the operative position as shown in FIG. 4, whereby the ink is sucked from the container 16 through the overflow tube 29 and the groove 26 into the ink pad 15. Of course, the suction exerted on the ink is dependent on the compression of the resilient ring 29, which may be adjusted by changing the level of the container by means of the screw 17. The maximum suction to be exerted on the ink is limited by a plurality of reducing openings 41 provided in the end piece 37 as indicated in FIG. 7. These reducing openings prevent too large an ink supply to the ink pad.

The pressure rod 22 is provided with a locking pin 42 by means of which the pressure rod may be held in its depressed position. For this purpose the pin is turned, in the depressed position of the pressure rod 22, below an abutment 43 provided on the housing 1. If the pin 42 is released from the abutment and the pressure rod 22 is likewise released, the latter is returned to the operative position by a spring 44. When the pressure rod has been depressed, the end piece 37 extends outside the housing 1, so that it may be readily exchanged.

In the preceding description, it was assumed that the printing apparatus is arranged in such manner that the longitudinal axes of the chambers 27 and 28 are vertical; however, it is also possible to arrange the apparatus in such manner that the said axes are horizontal. This is of great advantage when markings are to be applied to the underside of articles, which are suspended from the conveyor. Since the ink transport through the ink pad is not only dependent on gravity as in the known devices, but is performed by a suction exerted by the resilient ring 39, the ink container 16 need not be vertically arranged. If the ink container is in a horizontal position, care must be taken that the pigment particles can settle and are not supplied to the ink pad. In this case, the catch 31 must be placed in such a position that the axis of the upper chamber 28 of the container 16 is in a higher position than the axis of the lower chamber 27, so that the pigment particles are not taken along by the ink through the channel 30. In the chamber 27, there is a sufficient space around the inlet opening of the overflow tube 29 for the settling of the pigment particles.

I claim:

1. A printing apparatus for applying markings to a plurality of moving articles, said apparatus comprising a housing, a driving rod mounted for reciprocable movement within said housing, a stamp having opposite ends and including a holder having a longitudinal slot at one of said ends, a printing head at the other end of said holder and at least one spring connecting said printing head with said holder, said printing head having an end face, coupling means for coupling said stamp with said driving rod including a cross-piece fixedly attached to said driving rod, a T-shaped link including a leg and a cross-beam, said link being pivotally suspended from a fixed point of said housing at one end of said cross-beam and being pivotally connected with said holder in the vicinity of said printing head at the other end of said cross-beam while being pivotally connected with said cross-piece at the end of said leg, and a roller fixedly arranged in said housing and engaged in said slot such that said stamp can be displaced by reciprocating movement of said driving rod between a rest position, and an operating position at right angles with said rest position, an abutment in the path of said driving rod for interrupting the downward movement of said rod before said printing head has reached an article to be imprinted, whereby outward movement of said holder due to the rotation of said link around said fixed point is likewise interrupted, so that said printing head advances by its kinetic energy to strike the article and subsequently be retracted by said spring, an ink pad constituted by a rigid porous synthetic material positioned to engage said printing head in the rest position of said stamp, an ink container, a bearing ring attached to said ink container and having an inwardly directed flange retaining said ink pad against the bottom of said ink container, and a resilient ring mounted in the end face of said printing head so as to protrude from the same and be compressed and tightly engage the flange of said bearing ring in the rest position of said stamp, whereby a suction is exerted when said stamp is displaced to the operating position to draw the ink from said ink container into said ink pad.

2. A printing apparatus as claimed in claim 1, wherein said ink container has a bottom which is provided at its underside with an annular groove, the apparatus further comprising a feeding tube supplying ink from said ink container to said ink pad and terminating within said groove such that the ink is distributed over the surface of said ink pad by said groove.

3. A printing apparatus as claimed in claim 2, wherein said feeding tube is an overflow tube secured in the bottom of said ink container, said overflow tube having a top spaced from the bottom of said ink container.

4. A printing apparatus as claimed in claim 3, wherein said ink container comprises an upper chamber, a lower chamber and a channel interconnecting said chambers, said overflow tube being arranged in said lower chamber, said channel having an open top spaced from the bottom of the upper chamber.

5. A printing apparatus as claimed in claim 7, wherein said printing head is provided with at least one reducing opening for restricting the suction exerted by said resilient ring.

6. A printing apparatus as claimed in claim 1, further comprising a sleeve vertically displaceable with respect to said housing and having an L-shaped slot, an adjusting screw for displacing said sleeve, and a catch engaged in said ink container and enclosed by said L-shaped slot such that the level of said ink container can be adjusted with respect to the rest position of said stamp by means of said adjusting screw.

7. A printing apparatus as claimed in claim 1 comprising means for adjusting the degree of compression of said resilient ring in said rest position.

* * * * *